US005316183A

United States Patent [19]

Brovelli et al.

[11] Patent Number: 5,316,183

[45] Date of Patent: May 31, 1994

[54] WATER-SHOOTING TOY CONFIGURED AS A BOW AND ARROW

[75] Inventors: Virginio A. Brovelli, Taino, Italy; Mei H. Man, New Territories, Hong Kong

[73] Assignee: Lanard Toys Limited, Kowloon, Hong Kong

[21] Appl. No.: 967,697

[22] Filed: Oct. 27, 1992

[51] Int. Cl.[5] ..... G01G 13/00

[52] U.S. Cl. ..... 222/78; 222/378; 222/383

[58] Field of Search ..... 222/78, 79, 378, 379, 222/380, 383, 385, 386

[56] References Cited

U.S. PATENT DOCUMENTS

| | | | |
|---|---|---|---|
| 2,698,700 | 1/1955 | Grosh | 222/79 |
| 2,707,579 | 5/1955 | Vincent | 222/79 |
| 2,753,079 | 7/1956 | Hersey | 222/79 |
| 2,793,380 | 5/1957 | Brown et al. | 222/79 X |
| 2,856,863 | 10/1958 | Folley | 222/79 X |
| 3,013,697 | 12/1961 | Gill | 222/379 X |
| 3,146,911 | 9/1964 | Shun | 222/79 |
| 3,163,330 | 12/1964 | Ryan | 222/383 X |
| 3,578,789 | 5/1971 | Ferri | 222/79 |
| 3,581,956 | 6/1971 | Reid | 222/386 |
| 3,877,611 | 4/1975 | Morrison et al. | 222/78 |
| 4,911,364 | 3/1990 | Irie | 222/79 |

*Primary Examiner*—Kevin P. Shaver

*Attorney, Agent, or Firm*—Brumbaugh, Graves, Donohue & Raymond

[57] ABSTRACT

A water-shooting toy configured as a bow and arrow comprises a self-contained water pump sub-assembly and a case assembly. The pump sub-assembly includes a cylinder defining a pump chamber, a piston having a rod extending out from a body and a handle that is grasped by a user for manual operation of the pump. A nozzle is joined to the other end of the cylinder and has an opening that forms a stream of water upon operation of the pump. A one-way valve in the discharge passage permits water to flow through the discharge passage only from the pump chamber to the nozzle and prevents induction of air into the pump chamber through the nozzle inlet passage. A water passage into the pump chamber has a one-way inlet valve that admits water to the pump chamber upon the intake stroke of the pump and prevents discharge of water through the inlet passage upon the delivery stroke. The case is configured to resemble a bow and is composed of two wall members joined together and have wall portions that together define a water reservoir. The wall members have a pair of oppositely located openings intersected by the juncture between the case parts. The pump sub-assembly adjacent the water inlet is received within the reservoir with respective wall members straddling the pump sub-assembly, and the pump sub-assembly is joined and sealed to the case assembly within the case assembly openings.

20 Claims, 5 Drawing Sheets

WATER-SHOOTING TOY CONFIGURED AS A BOW AND ARROW

BACKGROUND OF THE INVENTION

The present invention relates to a water-shooting toy configured as a bow and arrow.

Water-shooting toys, such as the ubiquitous pistol-type squirt guns, have long been very popular. They are generally inexpensive, entirely safe, and provide great enjoyment to children of all ages. Currently very popular, even among adults, are air-pressurized squirt guns, millions of which have been sold in the last three or so years.

Water-shooting toys have been, and currently are, available in configurations other than guns. There are, for example, water-shooting toys configured as bows and arrows. The simulation of a bow and arrow contributes another aspect to the play value of the toy by appealing to the imagination in a different way than guns do.

Squirt guns and other water-shooting toys present something of a challenge to toy designers. Because they involve fluids under fairly high hydraulic pressures, special care has to be taken in their design to ensure that they do not leak, operate efficiently and will not break in normal use. It is, moreover, always an objective in toy design to keep manufacturing costs low without sacrificing durability, reliability and a long useful life. In addition, a high level of quality maintenance in production is essential to preventing losses, both economic and good will, due to defective products. The quality of the basic design of a toy also strongly influences its functionality and market appeal.

SUMMARY OF THE INVENTION

One object of the present invention is to provide a water-shooting toy that can be manufactured at low cost and is amenable to being produced with a minimum of defects. Another object is to make it possible to test the operating components of each toy produced for proper function before final assembly, thereby permitting any malfunctioning operating components to be repaired or discarded before additional losses in the form of the labor and parts costs of final assembly are incurred. Still another object is to improve the effectiveness of the operation of a water-shooting toy in terms of the distance it will shoot and the ease of operation.

The foregoing and other objects are attained, in accordance with the present invention, by a water-shooting toy configured as a bow and arrow that comprises a self-contained water pump sub-assembly and a case assembly. The pump sub-assembly includes a cylinder member defining a pump chamber, a piston member received in the cylinder member for axial movement therein, the piston member including a body portion received within the cylinder member and a piston rod portion extending from the body portion out of one end of the cylinder member and having a handle that is located externally of the cylinder member and is adapted to be grasped by a user for manual operation of the pump sub-assembly. A sealing ring is engaged between the piston body portion and the cylinder member. A nozzle member is joined to the other end of the cylinder member and has a water-discharge passage and a discharge nozzle opening that forms a stream of water upon operation of the pump sub-assembly. A one-way discharge valve in the discharge passage permits water to flow through the discharge passage only from the pump chamber to the nozzle and prevents induction of air into the pump chamber through the nozzle inlet passage. A water inlet passage into the pump chamber has a one-way inlet valve that admits water to the pump chamber upon the intake stroke of the pump and prevents discharge of water through the inlet passage upon the delivery stroke. The case is configured to resemble a bow and is composed of two wall members that are joined together and have wall portions that together define a water reservoir. The wall portions have a pair of oppositely located openings intersected by the juncture between the case parts. A portion of the pump sub-assembly adjacent the water inlet is received within the reservoir with the respective wall portions straddling the pump sub-assembly portion, and the pump sub-assembly is joined and sealed to the case assembly within the case assembly openings.

The fact the pump sub-assembly is completely self-contained means that it can be assembled in a fully operable state and can be tested operationally before being incorporated into the case. Any defective pump sub-assemblies can be repaired or discarded before the costs of the case parts and of final assembly of the toy are incurred. Also, testing before final assembly facilitates identifying production problems and taking the steps necessary to correct them at an early stage in the manufacturing process.

In preferred embodiments of the invention, the wall portions of the case parts along the respective openings that receive the pump sub-assembly have grooves, and the pump sub-assembly has flanges that are received in the grooves. The flanges and grooves join and seal the pump sub-assembly to the case. Advantageously, one flange of the pump sub-assembly is on the nozzle member and the other flange is on the cylinder member. These features simplify final assembly and enhance the durability and reliability of the product.

The present invention, in preferred embodiments, also has characteristics that better ensure against manufacturing defects and greatly enhance operating performance. Those characteristics include the following:

- Both the inlet valve and the outlet valve of the pump sub-assembly have ports bounded by valve seats and valve discs of elastomeric material that are movable into and out of engagement with the respective seats to close and open the respective valve—the elastomeric valve discs provide complete sealing against leakage, which significantly improves the operation of the toy, and also eliminate all problems of corrosion, which can occur with other materials;
- The piston body is composed of a first part integral with the piston rod and a separate end cover part, each of which is molded from a polymeric material. The first part and end cover part define a ring groove that receives the sealing ring, and the first part has a circular cylindrical ringland that engaged by the sealing ring and that is entirely smooth and free of any mold-parting lines. The smooth ringland ensures against leakage, thereby improving the pumping efficiency of the pump sub-assembly. Preferably, the end cover part is joined to the first part solely by a friction fit, thereby eliminating the need for a bonding material which, if not correctly applied during manufacture, could affect the operation of the sealing ring. This feature eliminates an important source of potential manufacturing defects.

The water inlet valve includes a coupling member forming part of the inlet passage and a valve body member joined to the coupling member and having a port bounded by a valve seat portion. The coupling member and body member define a compartment, and an elastomeric valve disc is received in the compartment for movement into and out of engagement with the valve seat portion. Preferably, the coupling member and body member are joined solely by a friction fit, thereby enhancing reliability of the inlet valve by eliminating the need for a bonding material which, if not correctly applied during manufacture, could render the valve inoperative. This feature eliminates an important source of potential manufacturing defects.

The body member includes a filter located upstream, with respect to water flow from the reservoir to the pump chamber, from the valve port. The filter prevents particulate material from getting into the pump, which would most likely sooner or later ruin the toy.

The outlet valve of the pump sub-assembly includes a cavity in the end of the cylinder member, a port communicating the cavity with the pump chamber and having a valve seat, an elastomeric sealing disc received in the cavity, a valve disc retainer member received in the cavity and joined to the cylinder member, and a light spring engaged between the retainer member and the valve disc and biassing the disc into engagement with the valve seat. Like the valve disc of the inlet valve and as mentioned above, the elastomeric valve disc provides a sure seal, which improves the operation of the pump on the intake stroke. The light spring keeps the valve closed when the toy is not being used, so that water remaining in the pump cannot dribble out, perhaps in an undesirable place.

In a preferred embodiment of the outlet valve, the valve disc retainer member and the cylinder member are joined solely by a friction fit, thereby enhancing the reliability of the manufacture of the outlet valve by eliminating the need for a bonding material, which, if not correctly applied, could make the valve inoperable.

One of the case parts has a water fill port communicating with the reservoir, and a cap is detachably received on the port. A flexible non-resilient cord joins the cap to the case. The cord keeps the cap from getting lost and because it is non-resilient, it does not tend to move the cap into the port when the toy is being filled with water and thus does not interfere with the filling.

For a better understanding of the invention, reference may be made to the following description of an exemplary embodiment, taken in conjunction with the accompanying drawings.

DESCRIPTION OF THE EMBODIMENT

Figure 1:
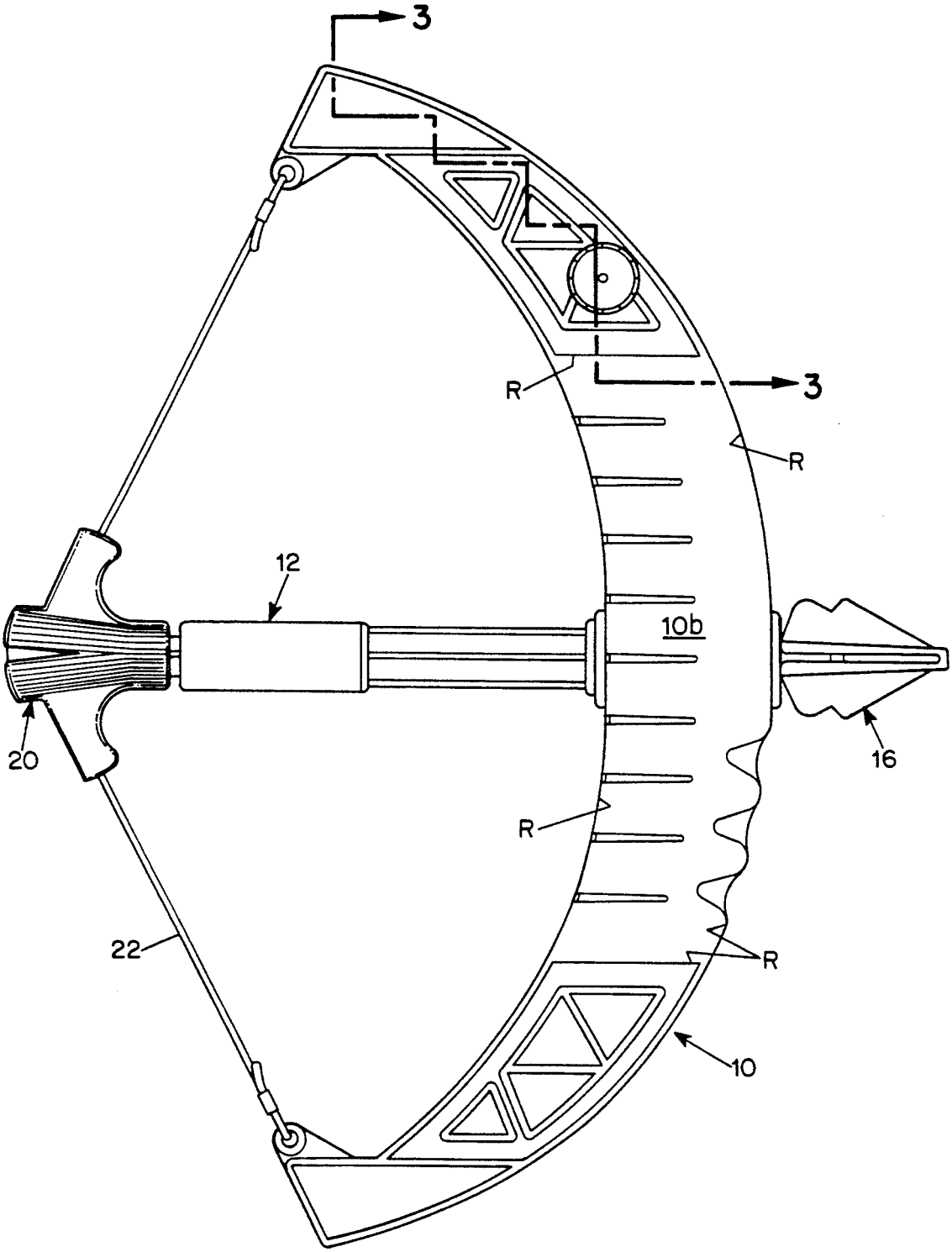
FIG. 1 is an elevational view of the right side of the embodiment.

The embodiment, as may be seen in FIG. 1, is configured as a bow and arrow, the bow being constituted by a case 10 that is of a generally crescent shape, and the arrow being a pump sub-assembly 12 that includes a nozzle at the tip 14 of a nozzle member 16 that is made to look like an arrow head, a cylinder member 18 that simulates the arrow shaft, and a handle 20, which does not look much like arrow feathers for functional reasons but still does not detract from the visual motif. An elastic cord 22 is connected between the ends of the case and passes through the handle; the cord is non-functional, in that it does not contribute significantly to the pumping action of the toy, which is entirely manually produced.

Figure 10:
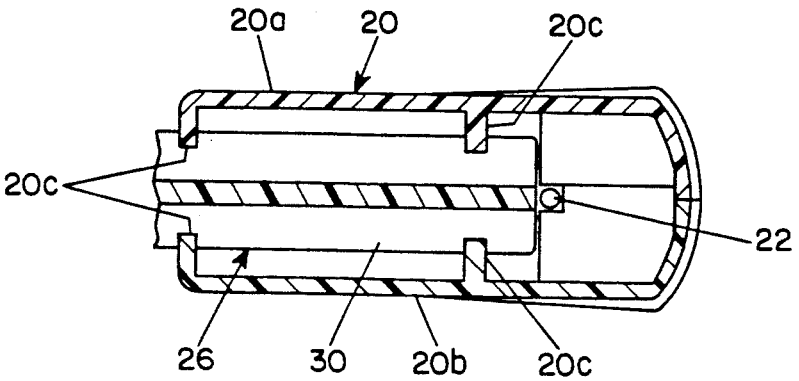
FIG. 10 is a detail cross-sectional view of the connection between the handle and the piston rod.

The cylinder member 18 has a main body part 18*a* that defines a pump chamber 24 and receives a piston member 26 for axial movement therein. The piston member includes a body portion 28 located within the chamber and a piston rod portion 30 of cross-shape in cross section extending from the body portion out of the rearward end of the cylinder member. The handle 20 is, of course, located externally of the cylinder member and is adapted to be grasped by a user for manual operation of the pump sub-assembly. The handle is made in two parts 20*a*, 20*b* that are bonder together and are coupled to the piston rod by ribs and grooves 20*c* (see FIG. 10).

A sealing ring 32 is engaged between the piston body portion 28 and the cylinder body part 18*a*. A cylinder outlet end part 18*b* is telescopically received over and bonded to the cylinder body part 18*a*. The nozzle member 16 is telescopically received within and bonded to the forward end of the cylinder end part 18*a* and has a water-discharge passage 34 and a discharge nozzle opening 36 adapted to form a stream of water upon operation of the pump sub-assembly.

A one-way discharge valve 38 in the end of the cylinder part 18*b* permits water to flow from the pump chamber 24 to the discharge passage 34 upon the forward delivery stroke of the pump and prevents induction of air into the pump chamber through the nozzle inlet passage during the rearward intake stroke of the pump. A water inlet passage 40 into the pump chamber is connected by a plastic tube 42 to a one-way inlet valve 44 and inducts water into the pump chamber on the pump intake stroke and prevents discharge of water through the inlet passage during the delivery strike of the pump.

Figure 2:
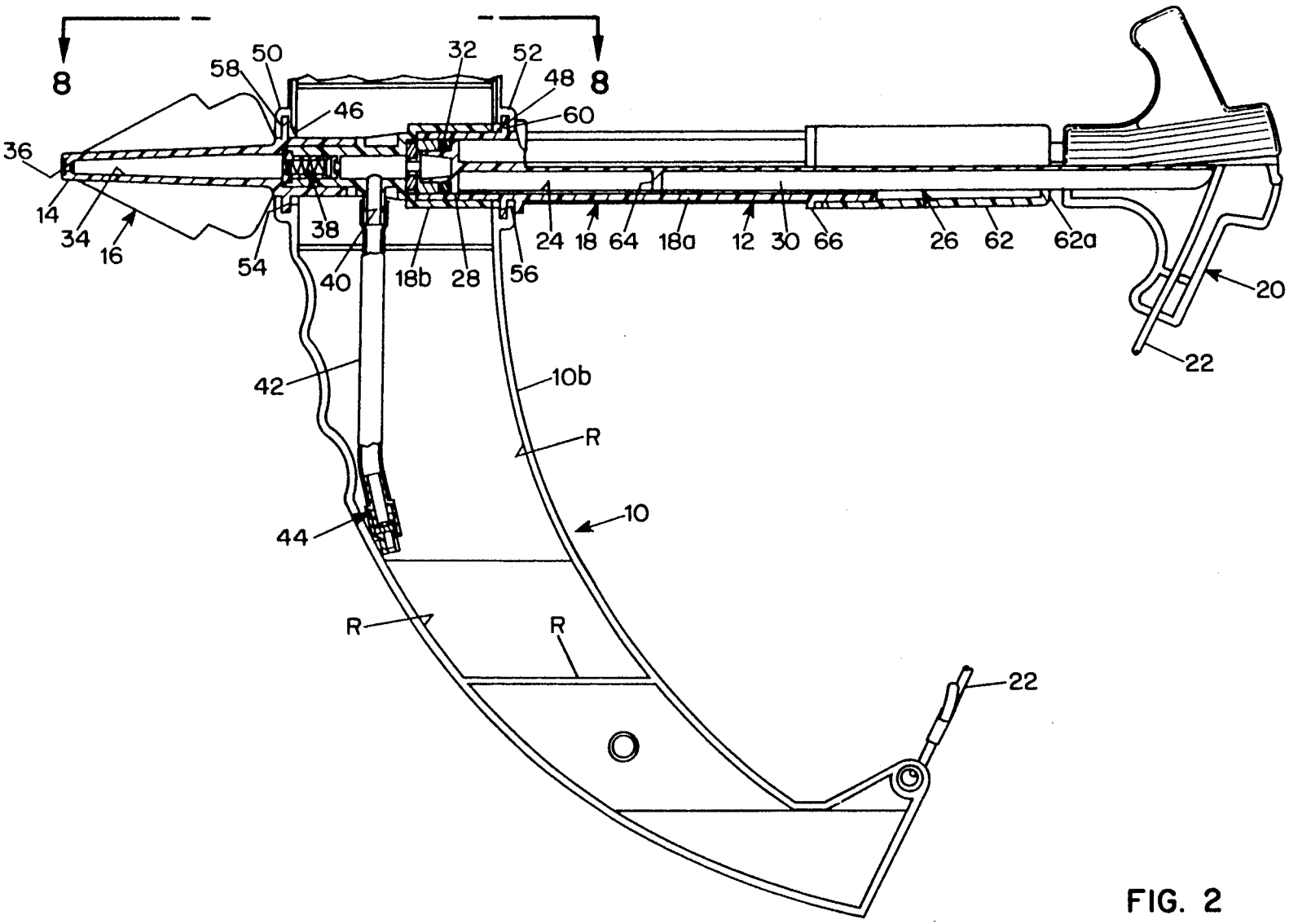
FIG. 2 is a partial side cross-sectional view of the left side of the embodiment.

The case 10 is composed of two parts 10*a*, 10*b* joined together at a juncture that lies in the plane of the paper in FIG. 2, each part constituting one-half of the case. The case parts 10*a*, 10*b* have respective wall portions that form crescent-shaped open boxes, which when placed edge to edge together define a water reservoir, the margins of which are labelled R in FIGS. 1 and 2. The end portions of each arm of the case 10 are ribbed for strength. The upper arm of each case part 10*a*, 10*b* is substantially symmetrical to the lower arm shown in FIG. 2 (see FIG. 1). The wall portions defining the reservoir have a pair of oppositely located openings 46, 48 that are intersected by the juncture between the case parts. A portion of the pump sub-assembly adjacent the water inlet is received within the reservoir with the respective wall portions straddling it, and the pump sub-assembly is joined and sealed to the case assembly within the case assembly openings.

In particular, each case part 10*a*, 10*b* has along the respective openings 46, 48 a boss portion 50, 52 formed with an inwardly open groove 54, 56, and the pump sub-assembly has flanges 58, 60 that fit into the respective grooves. The flanges fit into the grooves and join and seal the pump sub-assembly to the case assembly. At final assembly, a bonding material is applied to the case parts and the pump sub-assembly along all edges and surfaces that meet, thus mechanically joining the components and also making the reservoir water-tight.

A cap 62 fits telescopically over the rearward end of the cylinder part 18*a* and has a cross-shaped guide hole (not shown) in its end 62*a* that receives and guides the piston rod portion 28. A stop flange 64 on the piston rod portion limits the rearward intake stroke of the piston by engaging the end 62*a* of the cap 62. A mating lug and notch 66 on the cylinder member and cap ensure proper orientation of the cap on the cylinder member.

Figure 5:
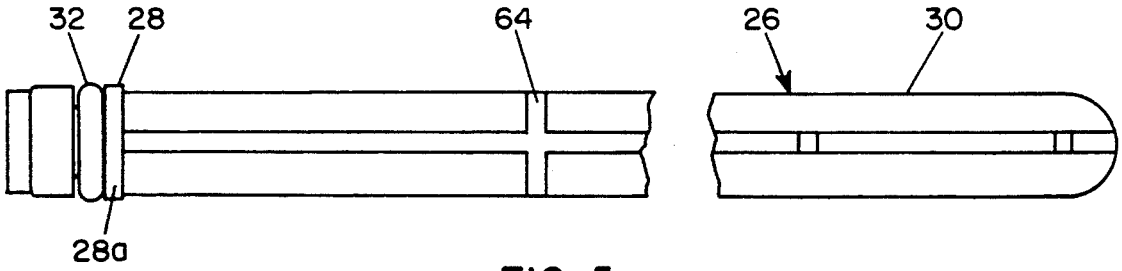
FIG. 5 is an side elevational view of the piston member.
Figure 6:
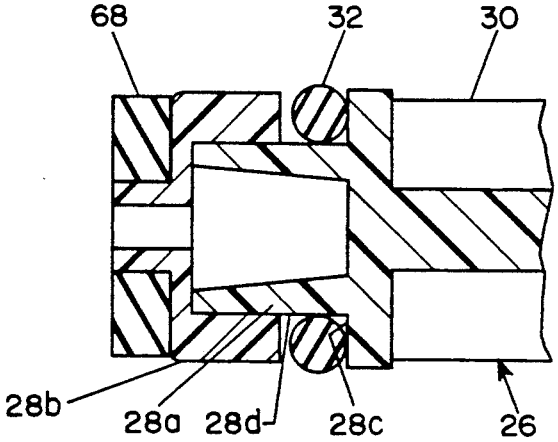
FIG. 6 is a detail side cross-sectional view of the piston body of the piston member, shown in a larger scale than in FIG. 5.

As may best be seen in FIGS. 5 and 6, the piston body portion 28 is composed of a part 28*a* that is integral with the piston rod portion 26 (?) and a separate end cover part 28*b*, each of which is molded from a polymeric material. The first part and end part define a ring groove 28*c* that receives the sealing ring 32, and the first part has a circular cylindrical ringland surface 28*d* that is engaged by the sealing ring and that is entirely smooth and free of any mold-parting lines. In this regard, the piston member 26 is injection molded in a three-part mold, the surface 28*d* being formed in a cavity in a mold part that has an annular groove matching the shape of the ring that forms the surface 28*d* and from which the piston member parts in the axial direction. The smooth ringland 28*d* ensures against leakage, thereby improving the pumping efficiency of the pump sub-assembly. An elastomeric impact cushion member 68 is press-fit onto the end of the member 28*b* and absorbs the impact of the piston member at the end of the delivery stroke.

The end cover part 28*b* of the piston body 28 is attached to the part 28*a* solely by a press-fit—i.e, no adhesive or bonding material is used. The reliability of manufacture of the toy is enhanced, inasmuch as the chance of an adhesive rendering the sealing ring 32 partly inoperative by presenting an irregular surface or altering its compressibility is eliminated.

Figure 7:
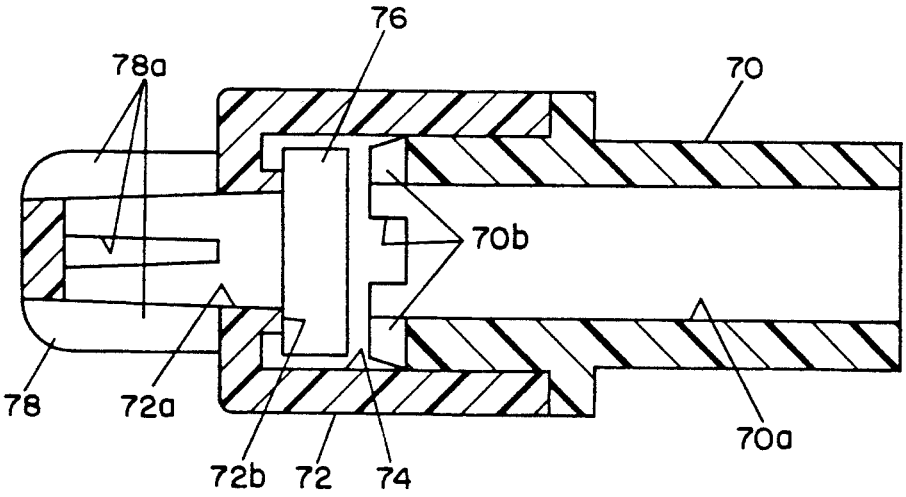
FIG. 7 is a detail side cross-sectional view of the intake valve.
Figure 8:
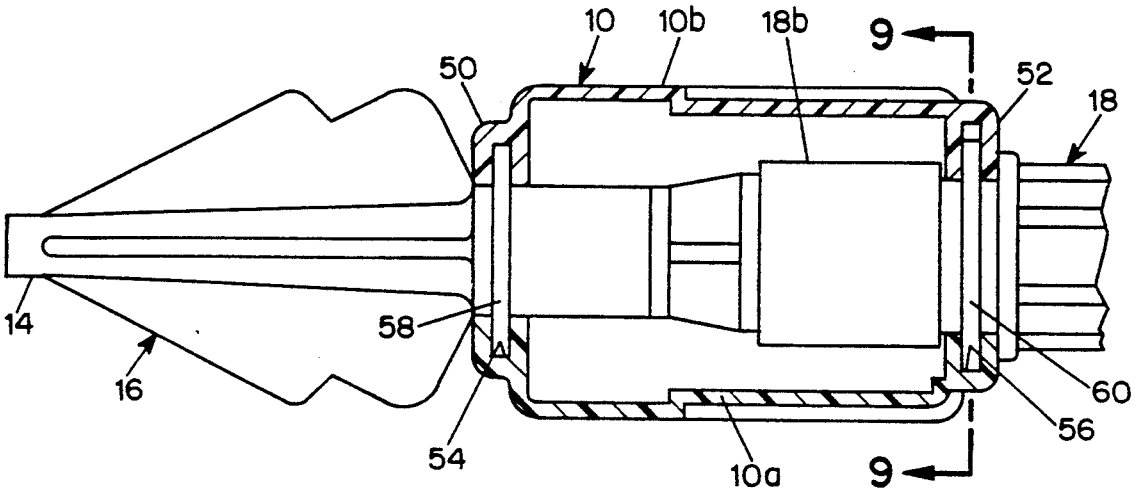
FIG. 8 is a top fragmentary detail cross-sectional view, showing the joint between the case parts and the pump sub-assembly.
Figure 9:
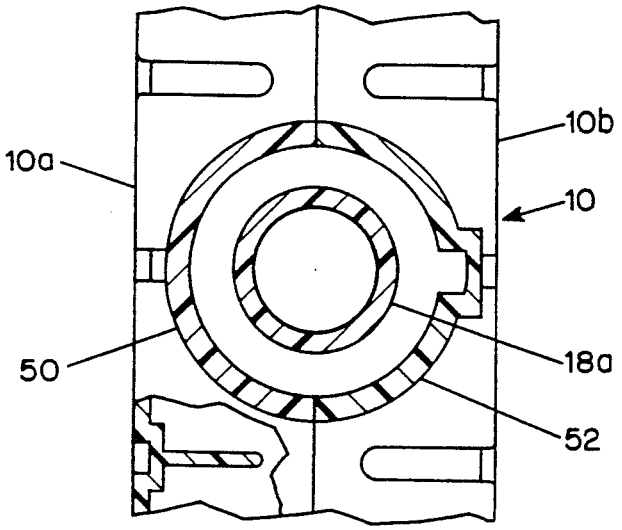
FIG. 9 is an end fragmentary detail cross-sectional view of the joint between the case parts and the pump sub-assembly.

The water inlet valve 44 (see FIG. 7) includes a coupling member 70 that is received within the end of the tube 42 and has a hole 70*a* opening to the tube. A valve body member 72 is joined to the coupling member and has a port 72*a* bounded by an annular rib that serves as a valve seat portion 72*b*. The coupling member and body member define a compartment 74, and an elastomeric valve disc 76 is received in the compartment with clearance for water flow and for movement into and out of engagement with the valve seat portion. On the intake stroke of the pump, the disc 76 moves out of engagement with the valve seat so that water can flow through the port. The circumferential clearance between the disc and the walls of the chamber 74 and notches 70*b* in the end of the coupling member 70 permit the water to flow through the valve to the passage hole 70*a* and thence through the tube 42 to the pump.

The coupling member 70 and body member 72 of the inlet valve are joined telescopically solely by a friction fit, thereby enhancing reliability of the inlet valve by eliminating the need for a bonding material which, if not correctly applied during manufacture, could render the valve inoperative. This feature eliminates an important source of potential manufacturing defects.

The body member 72 includes a filter 78 located upstream, with respect to water flow from the reservoir to the valve port. The filter, which is a series of slits 78*a* molded into the body member 78, prevents particulate material from getting into the intake valve or the pump, which would most likely sooner or later ruin the toy.

Figure 4:
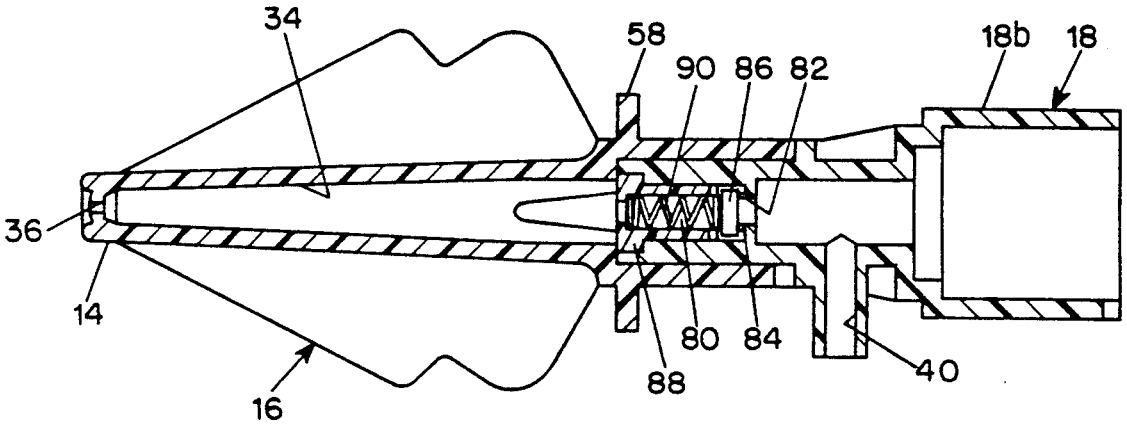
FIG. 4 is a side cross-sectional view of the nozzle member.

The discharge valve 38 of the pump sub-assembly, as may best be seen in FIG. 4, includes a cavity 80 in the end of the cylinder member part 18*a*, a port 82 communicating the cavity with the pump chamber and having an annular valve seat 84, an elastomeric sealing disc 86 received in the cavity, a valve disc retainer member 88 received in the cavity and joined to the cylinder member, and a light spring 90 engaged between the retainer member and the valve disc and biasing the disc into engagement with the valve seat. The elastomeric valve disc provides a sure seal, which improves the operation of the pump on the intake stroke. The light spring keeps the valve closed when the toy is not being used, so that water remaining in the pump cannot dribble out, perhaps in an undesirable place.

The valve disc retainer member 88 and the cylinder member part 18*a* are joined solely by a friction fit, thereby enhancing the reliability of the manufacture of the outlet valve by eliminating the need for a bonding material, which, if not correctly applied, could make the valve inoperable.

Figure 3:
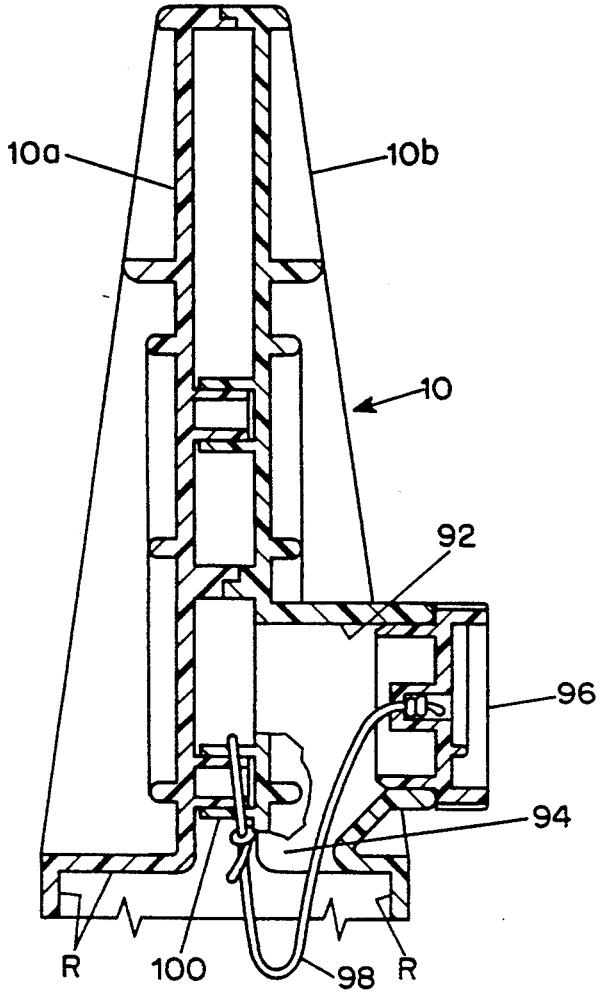
FIG. 3 is a detail cross-sectional view of the end portion of the upper arm of the case, taken along a broken plane indicated by the lines 3—3 of FIG. 1.

Referring to FIG. 3, the upper arm one of the case parts lob has a water fill port 92 communicating with the reservoir through a passage 94, and a cap 96 is detachably received on the port. A flexible non-resilient cord 98 joins the cap to a boss 100 within the case. The cord keeps the cap from getting lost and because it is non-resilient, it does not tend to move the cap into the port when the toy is being filled with water and thus does not interfere with the filling.

We claim:

1. A water-shooting toy configured as a bow and arrow comprising a self-contained water pump sub-assembly having a cylinder member defining a pump chamber, a piston member received in the cylinder member for axial movement therein, the piston member including a body portion and a piston rod portion extending from the body portion out of one end of the cylinder member and having a handle located externally of the cylinder member adapted to be grasped by a user for manual operation of the pump sub-assembly, a sealing ring engaged between the piston body portion and the cylinder member, a nozzle member joined to the other end of the cylinder member and having a water-discharge passage and a discharge nozzle opening adapted to form a stream of water upon operation of the pump sub-assembly, a one-way discharge valve in the discharge passage adapted to permit water to flow through the discharge passage only from the pump chamber to the nozzle and to prevent induction of air into the pump chamber through the nozzle inlet passage, and a water inlet passage into the pump chamber and having a one-way inlet valve adapted to admit water to the pump chamber upon movement of the piston member toward said one end of the cylinder member and to prevent discharge of water through the inlet passage when the piston is moved toward the other end of the cylinder member; and a case assembly configured to resemble a bow and being composed of two parts joined together at a juncture, the case parts having respective wall portions that together define a water reservoir, the wall portions having a pair of oppositely located openings intersected by the juncture between the case parts, a portion of the pump sub-assembly adjacent the water inlet being received within the reservoir with the respective wall portions straddling said pump sub-assembly portion, the wall portions of the case parts along the respective openings having grooves and the pump sub-assembly having flanges received in the grooves, the flanges and grooves joining and sealing the pump sub-assembly to the case assembly.

2. A water-shooting toy according to claim 1 wherein one flange of the pump sub-assembly is on the nozzle member and the other flange is on the cylinder member.

3. A water-shooting toy according to claim 1 wherein both the inlet valve and the outlet valve of the pump sub-assembly have ports bounded by seats and elastomeric valve discs movable into and out of engagement with the respective seats.

4. A water-shooting toy according to claim 1 wherein the piston body is composed of a first part integral with the piston rod and a separate second end cover part, each of which is molded from a polymeric material, wherein the first part and end part define a ring groove that receives the sealing ring, and wherein the first part has a circular ringland engaged by the sealing ring that is entirely smooth and free of any mold-parting lines, whereby the pumping efficiency of the pump sub-assembly is enhanced.

5. A water-shooting toy according to claim 4 wherein the end cover part is joined to the first part solely by a friction fit, thereby eliminating the need for a bonding material and an important source of potential manufacturing defects.

6. A water-shooting toy according to claim 1 wherein the water inlet valve includes a coupling member forming part of the inlet passage, a valve body member joined to the coupling member and having a port bounded by a valve seat portion, the coupling member and body member defining a compartment, and an elastomeric valve disc received in the compartment for movement into and out of engagement with the valve seat portion.

7. A water-shooting toy according to claim 6 wherein the coupling member and body member are joined solely by a friction fit, thereby enhancing the reliability of the inlet valve by eliminating the need for a bonding material and a potential cause of manufacturing defects.

8. A water-shooting toy according to claim 6 wherein the valve body member includes a filter located upstream, with respect to water flow from the reservoir to the pump chamber, from the valve port.

9. A water-shooting toy according to claim 1 wherein, the outlet valve of the pump sub-assembly includes a cavity in said other end of the cylinder member, a port communicating the cavity with the pump chamber and having a valve seat, an elastomeric sealing disc received in the cavity, a valve disc retainer member received in the cavity and joined to the cylinder member, and a light spring engaged between the retainer member and the valve disc and biassing the disc into engagement with the valve seat.

10. A water-shooting toy according to claim 9 wherein the valve disc retainer member and-the cylinder member are joined solely by a friction fit, thereby enhancing the reliability of the outlet valve by eliminating the need for a bonding material and a potential source of manufacturing defects.

11. A water-shooting toy according to claim 1 wherein one of the case parts has a water fill port communicating with the reservoir and further comprising a cap detachably received on the port and a flexible cord joining the cap to the case.

12. A self-contained water pump sub-assembly for a water-shooting toy, the sub-assembly being adapted to being joined to a case having a water reservoir, comprising a cylinder member defining a pump chamber, a piston member received in the cylinder member for axial movement therein, the piston member including a body portion and a piston rod portion extending from the body portion out of one end of the cylinder member and having a handle located externally of the cylinder member adapted to be grasped by a user for manual operation of the pump sub-assembly, a sealing ring engaged between the piston body portion and the cylinder member, a nozzle member joined to the other end of the cylinder member and having a water-discharge passage and a discharge nozzle opening adapted to form a stream of water upon operation of the pump sub-assembly, a one-way discharge valve in the discharge passage adapted to permit water to flow through the discharge passage only from the pump chamber to the nozzle and to prevent induction of air into the pump chamber through the nozzle inlet passage, and a water inlet passage into the pump chamber and having a one-way inlet valve adapted to admit water to the pump chamber upon movement of the piston member toward said ne end of the cylinder member and to prevent discharge of water through the inlet passage when the piston is moved toward the other end of the cylinder member, the inlet valve having a port bounded by an annular raised rib defining a seat and an elastomeric valve disc movable into and out of engagement with the seat, and the seat having a diameter less than the diameter of the disc.

13. A water pump sub-assembly according to claim 12 wherein the outlet valve of the pump sub-assembly has a port bounded by an annular raised rib defining a seat and an elastomeric valve disc movable into and out of engagement with the seat, the seat having a diameter less than the diameter of the disc.

14. A water pump sub-assembly according to claim 12 wherein the piston body is composed of a first part integral with the piston rod and a separate second end cover part, each of which is molded from a polymeric material, wherein the first part and end part define a ring groove that receives the sealing ring, and wherein the first part has a circular ringland engaged by the sealing ring that is entirely smooth and free of any mold-parting lines, whereby the pumping efficiency of the pump sub-assembly is enhanced.

15. A water pump sub-assembly according to claim 14 wherein the end cover part is joined to the first part solely by a friction fit, thereby eliminating the need for a bonding material and an important source of potential manufacturing defects.

16. A water pump sub-assembly according to claim 12 wherein the water inlet valve includes a coupling member forming part of the inlet passage, a valve body member joined to the coupling member and having the port and rib formed on it bounded by a valve seat portion, the coupling member and body member defining a compartment, and the elastomeric valve disc being received in the compartment for movement into and out of engagement with the valve seat.

17. A water-shooting toy according to claim 16 wherein the coupling member and body member are joined solely by a friction fit, thereby enhancing the reliability of the inlet valve by eliminating the need for a bonding material and a potential cause of manufacturing defects.

18. A water-shooting toy according to claim 16 wherein the valve body member includes a filter located upstream, with respect to water flow from the reservoir to the pump chamber, from the valve port.

19. A water-shooting toy according to claim 12 wherein the outlet valve of the pump sub-assembly includes a cavity in said other end of the cylinder member, a port communicating the cavity with the pump chamber and having a valve seat, an elastomeric sealing disc received in the cavity, a valve disc retainer member received in the cavity and joined to the cylinder member, and a light spring engaged between the retainer member and the valve disc and biassing the disc into engagement with the valve seat.

20. A water-shooting toy according to claim 19 wherein the valve disc retainer member and the cylinder member are joined solely by a friction fit, thereby enhancing the reliability of the outlet valve by eliminating the need for a bonding material and A potential source of manufacturing defects.

* * * * *

UNITED STATES PATENT AND TRADEMARK OFFICE

CERTIFICATE OF CORRECTION

PATENT NO. : 5,316,183

DATED : May 31, 1994

INVENTOR(S) : Brovelli et al.

It is certified that error appears in the above-indentified patent and that said Letters Patent is hereby corrected as shown below:

Column 6, line 48, "lob" should read --10b--;
Column 8, line 47, "ne" should read --one--; and
Column 10, line 21, "and A" should read --and a--.

Signed and Sealed this

Eighteenth Day of October, 1994

*Attest:*

*Attesting Officer*

Bruce Lehman

BRUCE LEHMAN

*Commissioner of Patents and Trademarks*